US008397931B2

(12) United States Patent
Palmer

(10) Patent No.: US 8,397,931 B2
(45) Date of Patent: Mar. 19, 2013

(54) INTERCHANGEABLE COSMETIC, MEDICAL, TOY PACKAGE ELEMENTS

(76) Inventor: Barbie Palmer, Manhattan Beach, CA (US)

( * ) Notice: Subject to any disclaimer, the term of this patent is extended or adjusted under 35 U.S.C. 154(b) by 493 days.

(21) Appl. No.: 12/455,082

(22) Filed: Aug. 31, 2009

(65) Prior Publication Data

US 2010/0025280 A1 Feb. 4, 2010

Related U.S. Application Data

(63) Continuation-in-part of application No. PCT/CA2007/002191, filed on Nov. 30, 2007.

(60) Provisional application No. 11/565,052, filed on Nov. 30, 2006.

(51) Int. Cl.
*B65D 6/28* (2006.01)
*B65D 8/18* (2006.01)

(52) U.S. Cl. ..... 220/4.27; 206/508

(58) Field of Classification Search ..... 206/45.2, 206/385, 503, 508, 509; 220/4.25, 4.27; 401/18

See application file for complete search history.

(56) References Cited

U.S. PATENT DOCUMENTS 2,975,930 A * 3/1961 Pennington et al. ..... 220/23.4
3,292,840 A * 12/1966 Schmidt ..... 220/4.25
4,103,774 A * 8/1978 Shingyouchi ..... 206/45.2
6,464,418 B1 * 10/2002 Visser et al. ..... 401/34

* cited by examiner

*Primary Examiner* — Harry Grosso

(57) ABSTRACT

A cosmetic, medical/pharmaceutical, toy container consisting of a sealable element that may be connected to other package elements to form an assembly of cosmetic, medical, pharmaceutical, toy packages.

The container permits the combination and substitution of package elements within the assembly. In a preferred embodiment, the package elements may be oriented in either direction within the assembly, irrespective of the location or orientation of adjacent elements.

19 Claims, 16 Drawing Sheets

Figure 12a
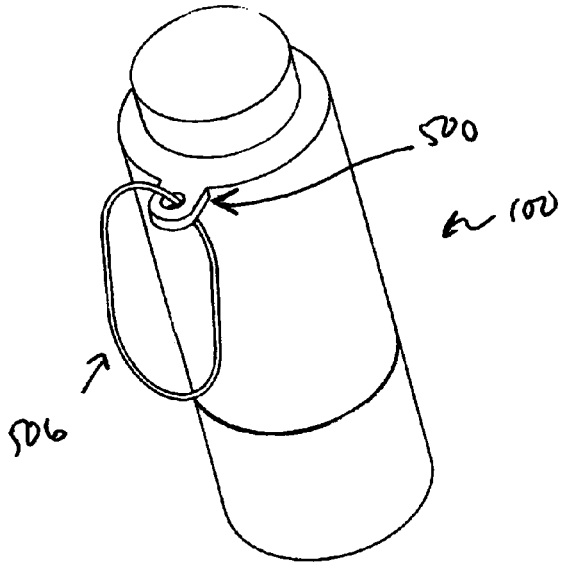
Figure 12b
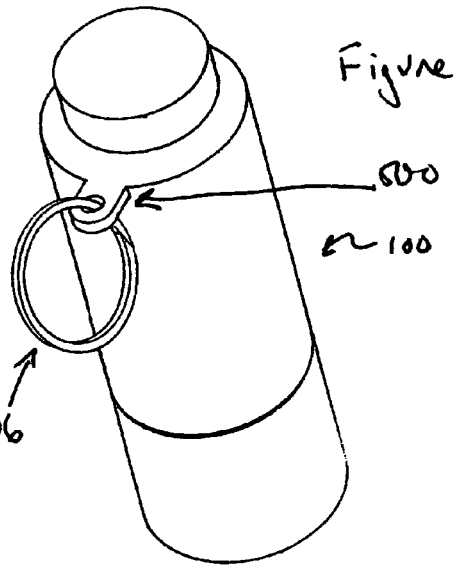
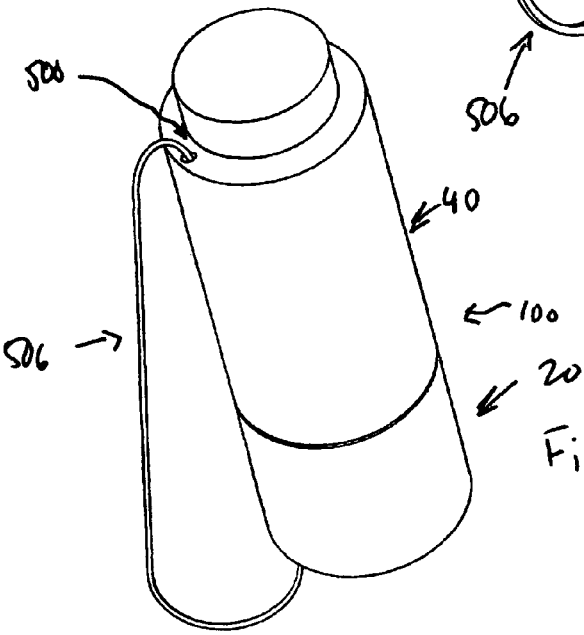
Figure 12c

100

500
502
100
40
502
20
502, 500
40
100
502
300
20
100
502, 500
40
502, 500
20
502
500

INTERCHANGEABLE COSMETIC, MEDICAL, TOY PACKAGE ELEMENTS

THIS IS A CONTINUATION IN PART OF PCT/CA2007/002191 FILED ON 30 Nov. 2007 WHICH CLAIMS IS PRIORITY U.S. application Ser. No. 11/565,052 FILED 30 Nov. 2006 THAT THIS UTILITY PCT PATENT CAN BE USED FOR MAKE-UP, COSMETICS, MEDICAL, PHARMACEUTICAL AND TOYS.

FIELD OF INVENTION

The present invention is directed towards cosmetics, medical, and toy packages. More specifically, the present invention is directed to individual cosmetic, medical and toy packages they may be combined with one another to form an implement for applying cosmetics, applying medicine, or the use of housing of toys.

BACKGROUND OF THE INVENTION

It is well know that cosmetics, medicine need to be re-applied throughout the day during use. Further, it is well known that different colors and shades of make-up are worn at different times in the day, as well as different medicines or toys are used at different times of the day. A person going out at night will typically apply a darker shade of make-up and may apply other highlights that would not be necessary in the day. The same as for medicine as far as what medicinal use at night would differ from daytime use, and what toys would be played with at different times of the day or night.

One problem with re-applying make-up, medicine or using toys in the day is that carrying a full size cosmetic, medical, toy containers covering all the cosmetics, medicine and toys to be applied and used can be cumbersome. Prior attempts at providing portable cosmetics, medicinal and toy packages have included combining multiple portable cosmetic, medical and toy containers within a single assembly. Typically, these assemblies have comprised an elongated applicator that is made up of multiple cosmetic, medical, toy package elements that may be engaged or disengaged to expose individual cosmetics, medicine or toys.

U.S. Pat. No. 3,592,202 (Jones) is directed towards a fingernail polish kit that comprises a tube, one end of the tube containing nail polish remover and the other end containing nail polish and the applicator brush container. The central portion of the tube may contain a wiping material, such as cotton to assist with the manicuring process. The limitation of this process is that only two cosmetic, medical, toy package elements may be connected with the tube, one at each end.

An improvement of the Jones assembly was described in U.S. Pat. No. 5,881,742 (Hunsberger). Huntsberger teaches an assembly with multiple tubes. Each tube serves to connect two cosmetic package elements and serves as a lid to protect the make-up. A second embodiment shows multiple cosmetic package elements, each element including a hollow base for receiving another cosmetic package element. The limitation of this package design is that cosmetic package elements are not interchangeable in order as the base of one element is used as the cover of a connecting element. The elements are not interchangeable as many cosmetics are not mixable, due to material compatibility issues. In the first embodiment, adjacent makeup elements share the same cover. In the second embodiment, once a cosmetic package element has been introduced into the base of an adjacent element, it should not be replaced with a different element to avoid mixing or contamination of the cosmetics, medicine or toys. While the Huntsberger assembly may be acceptable for powder or other solid cosmetics, it would not be suitable for other liquid or paste cosmetics, medicine and toys such as mascara, foundation or lipstick, or, chap stick medicine for the lips, medicinal ointments or medicinal sprays or suitable for housing the contents of toys. An additional limitation is that the length of the assembly will change depending upon which element is being used, as opposed to the preference of the user. For instance, the last package element has no adjoining elements connected to its base.

U.S. Pat. No. 6,637,963 (Huang) discloses a cosmetic package assembly that is suitable for liquid or paste cosmetics. Huang discloses a single arrangement assembly, wherein the central cosmetic package assembly includes two cosmetic applicators back to back. A cover or reservoir, for each of the application is formed integrally with the base of the end cosmetic package elements. A limitation of the Huang assembly is that individual elements are combined in a fixed relationship and individual elements cannot be easily combined, exchanged or removed. Thus a user is not able to exchange individual elements to select preferred shades of makeup, medicine or toy types. Furthermore, only the full assembly may be used as the applicator with the end elements.

U.S. Pat. No. 6,568,529 (McMurrey) discloses a nestable cosmetic package assembly. Similar to Hunsberger, the base of each cosmetic package element forms the cover for the adjacent interconnecting element. A separate plug may be provided for the base of the end of the element.

All of the elements suffer from two distinct disadvantages. First, the individual cosmetic package elements can only be rearranged or exchanged where compatible cosmetics, medical and toys are contained in alternative elements. Second, the length of the assembly is fixed since removing an element deprives the assembly of a cover to seal the cosmetic, medical and toy contained within the adjacent element.

There thus exists a need for a cosmetic, medical and toy package assembly that permits a user to change the composition of the makeup, medical and toy products contained in the assembly.

There thus exists an additional need for a cosmetic, medical and toy package assembly that permits a user to change the number of cosmetic, medical and toy package elements in the assembly, and subsequently the size of the assembly.

There thus exists a further need for a cosmetic, medical and toy package assembly that overcomes the limitations of the prior art and allows for the interchange and exchange of individual cosmetic, medical and toy package elements.

BRIEF DESCRIPTION OF DRAWINGS

In drawings which illustrate by way of example only a preferred embodiment of the invention.

FIG. 12*a* is a front elevational view of a cosmetic, toy, or medical/pharmaceutical container, showing how the invention can be carried with a connector.

FIG. 12*b* is a key ring connector with a tab external.

FIG. 12*c* is a side elevational view an internal and external connector.

FIG. 14*a* is a front elevational view of a connector threaded through the passage of several elements to secure the assembly.

DETAILED DESCRIPTION OF THE INVENTION

Figure 1:
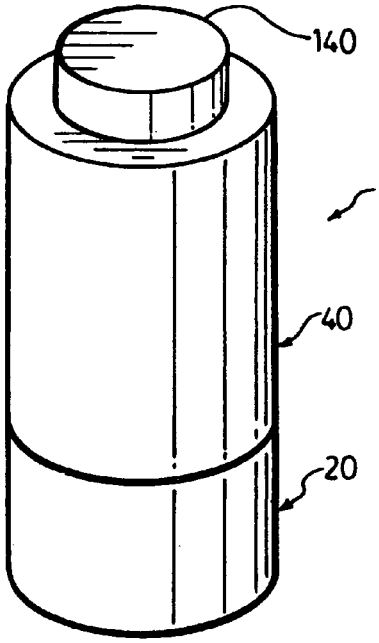
FIG. 1 is an isometric view of an individual cosmetic, medical and toy package element according to an embodiment of the present invention.

In an embodiment the present invention provides a package element for storing a cosmetic, medicine, toys, the element comprising a cosmetic, medical, or toy, the element comprising a cosmetic, medical, toy container comprising a container element connector and a container closure connector: and, a container closure compromising a complementary element connector for connecting to the container element connector and a complementary closure connector for connecting to the container closure connector to releasably seal the container closure to the cosmetic, medical toy container; whereby the container element connector of a first package element may be connected to a complementary element connector of a second package element for connecting the cosmetic, medical, toy container of the first package element to the cosmetic, medical, toy closure of the second package element.

In a further aspect of the embodiment the second element forms all or part of a handle for manipulating the first package element.

In yet a further aspect of the embodiment, a package element assembly may be provided comprising at least two package elements connected by connecting the element connector of the first package element with the complementary element connector of the second package element.

In yet a further aspect of the embodiment, a central package element may be provided for connecting to two package elements, the central package element comprising, a pair of container closures each comprising a container element connector, and one container closure comprising a container closure connector and the other comprising a complementary closure connector for connecting to the closure connector to releasably seal the central package element; whereby the container closures of the central package element may be combined with the complimentary element connectors of the two package elements.

In yet a further aspect of the embodiment, a package assembly may be provided comprising the central packet element connected to at least two package elements by combining the complementary element connector of a first package element with the element connector of the container and combining the complementary element connector of a second package element with the element connector of a container closure.

In an alternate embodiment the present invention provides a package element for storing a cosmetic, medicine, toy, the element comprising a cosmetic, medical, toy container comprising a container element connector, a complementary element connector and a closure connector, the complementary element connector adapted to connect with the container element connector, and, a container closure comprising a container element connector, a complementary connector and a complementary element connector and a complementary closure connector for connecting to the closure connector to releasably seal the cosmetic, medical, toy container; whereby both the cosmetic, medical, toy container element connector may be connected to either a container closure of another package element or a cosmetic, medical, toy container of another package element.

FIG. 1 illustrates an isometric view of an embodiment of a cosmetic, medical, toy package element according to the present invention. As will be appreciated, the figures are illustrations highlighting the workings of the present invention and are not intended to be scale drawings of an actual cosmetic, medical, toy package product. For instance, the element connectors and closure connectors.

Referring to FIG. 1, an individual cosmetic, medical, toy package element 100 is comprised of a cosmetic, medical, toy container 20 and a container 40. The cosmetic, medical, toy container 20 includes an element connector 120 and the container closure 40 includes a complementary element connector 140. The outer configuration of the cosmetic, medical, toy container 20 and container closure 40 serves multiple functions: to aid in combining individual elements 100, to protect a cosmetic, medical, toy 200 or applicator 250 contained within the element 100, and to provide structural rigidity in combination with other elements 100 to comprise an assembly 300 that comprises an applicator suitable for applying a cosmetic, medical toy 200 or employing an applicator 250 contained in the end element 100 of the assembly 300.

Figure 2A:
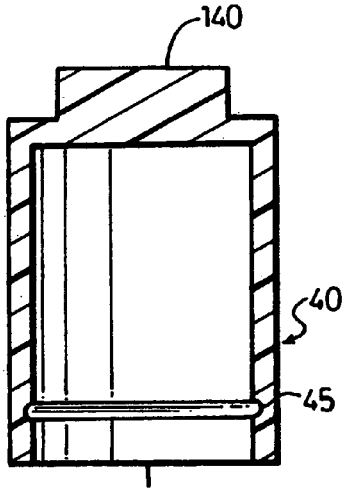
FIG. 2*a* is a side section view illustration of a first embodiment of the cosmetic, medical and toy package element with closure connected to the container to seal the container
Figure 2A:
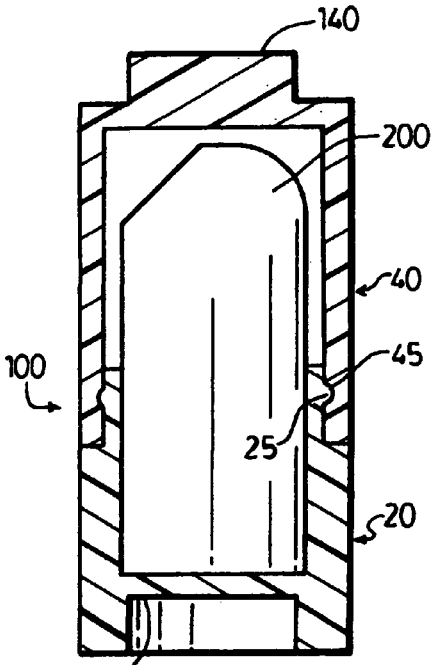

Referring to FIG. 2*a* the cosmetic, medical, toy container 20 has a container closure connector 25 while the container closure 40 has a complementary closure connector 45 that may be connected to the container closure connector 25 to releasably seal the container. Preferably, the container closure connector 25 and the complementary closure connector 45 are compatible with the choice of element connector 120 and complementary element connector 140. For instance, a press-connect type element connector 120 and complementary element connector 140 would be compatible with a threaded closure connector 27 and complementary closure connector 47, while a tongue and groove element connector 120 and complimentary element connector 140 would be compatible with either a threaded closure connector 27 and complementary closure connector 47 or a press-fit container closure connector 25 and complementary closure connector 45. As will be appreciated, the terms container 20 and container closure 40 are relative terms, and the orientation of a container closure 40 within a makeup, medical, toy assembly need not be fixed.

That is, a first element 100 may be oriented with a container closure 40 having a complementary element connector 140, while a second element could be orientated with a container closure 40 having a element connector 120. While it is preferred to consistently locate a cosmetic, medical, toy 200 in a container 20 having an element connector 120 and sealed by a container closure 40 having a complementary element connector 140, the consistent orientation of locating the cosmetic 200 in the container 20 is not a requirement of the invention and the cosmetic 200 may be located in the container closure 40 without departing from the spirit of the invention. This orientation may be convenient where an applicator 250 may be preferably provided with an element connector 120 for ease of use in assembly 300.

While the invention is depicted having lipstick as a cosmetic, medical, toy 200, it will be apparent that other cosmetics, medicines, toys may be substituted in place of lipstick, medical, toys as the cosmetic, medical, toy 200. For instance, without limitation, the cosmetic, medical, toy 200 may comprise a lipstick, mascara, nail polish, eye liner, foundation, perfume, brush, applicator, clipper, eye lash curler, pencil, or other beauty products, as well as without limitation, medical products, which could be comprised of medicinal lip balm, spray medicinal products, medicinal ointments, elements to house medicine in pill form, a toothpaste, mouthwash, medical spray for burns, a glucometer for diabetics, an epi pen, lancet, peak flow meter asthma inhaler humalog pen, or other medical pharmaceutical products. As well as without limitation small toys can be housed in the interchangeable elements, which may be comprised of miniature or small dolls, cars, trucks, face paint or other toy products. Further, the figures are included for illustrative means only and are not meant to limit the cosmetics, medical, toys depicted to the type, configuration or scale shown. For instance the lipstick is shown as being a solid stick of cosmetic and a pencil is shown in FIG. 4*a* in a non-scale fashion.

As will be apparent since each element 100 includes its own container closure 40, all elements 100 may be interchangeably assembled adjacent to one another regardless of compatibility of the particular cosmetic, medical, toy 200 in a first element 100 with the cosmetic 200 in the adjacent element 100. Thus contamination of one cosmetic, medical, toy 200 with another cosmetic, medical, toy 200 is avoided. Moreover, the elements of 100 are only unsealed, thus exposing a cosmetic, medical, toy 200, when a user intends to apply the cosmetic, medical, toy product.

Figure 3A:
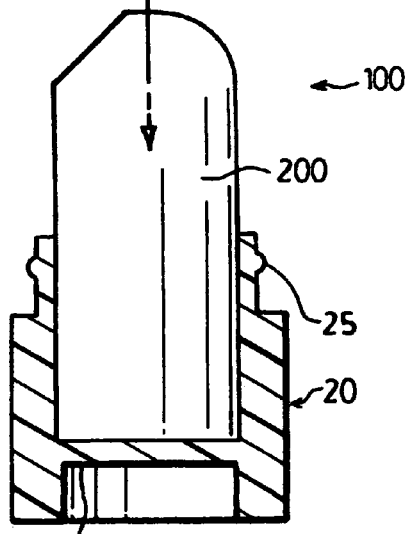
FIG. 3*a* is a side section view illustration of the first embodiment of the cosmetic, medical, toy package element with the closure separated from the container.
Figure 2B:
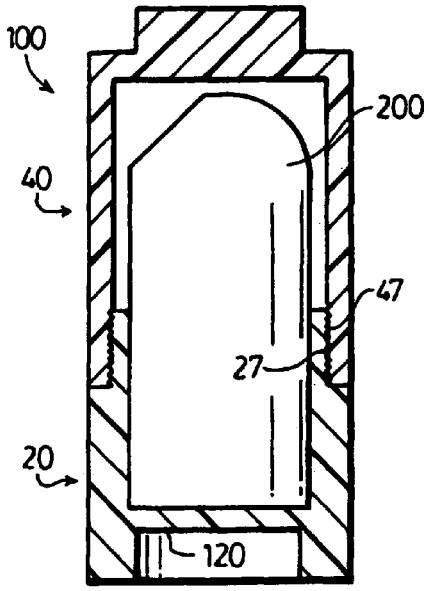
FIG. 2*b* is a side section view illustration of a second embodiment of the cosmetic, medical and toy package element with the closure connected to the container to seal the container.
Figure 3B:
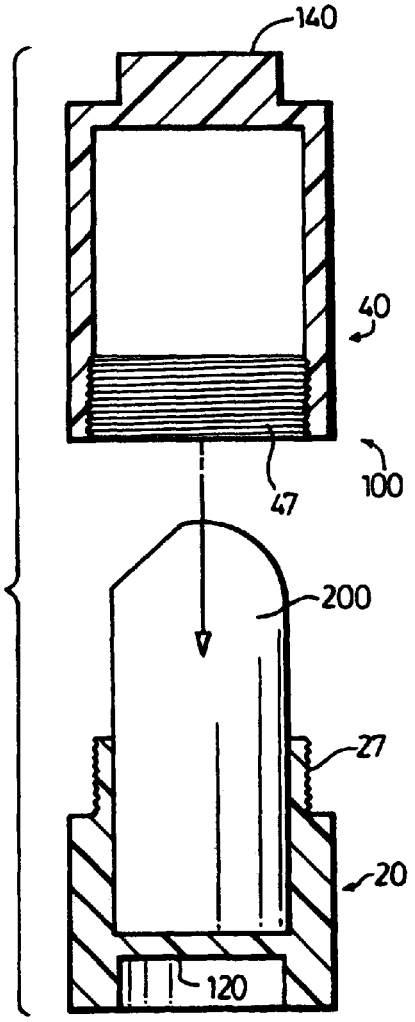
FIG. 3*b* is a side section view illustration of the second embodiment of the cosmetic, medical, toy package element with the closure separated from the container.

FIG. 3*a* illustrates the closure of container closure 40 onto the cosmetic, medical, toy container 20. The container closure 40 releasably seals the cosmetic, medical, toy 200 or cosmetic, medical, toy applicator 250 housed within the cosmetic, medical, toy container 20. Preferably the container closure 40 forms an airtight seal with the cosmetic, medical, toy container 20 when engaged, that the engaged container closure 40 and cosmetic, medical, toy container 20 form a component suitable for storing cosmetics, medical/pharmaceutical, toys. In a preferred embodiment illustrated in FIGS. 2*b* and 3*b*, the seal is achieved by a closure connector comprised of complementary threads 27 and 47 in the container closure 40 and cosmetic, medical, toy container 20. Alternatively, where compatible with the interconnect mechanism, the seal may be achieved either by complementary threads 27 and 47 or a press-fit seal 25 and 45.

Figure 4A:
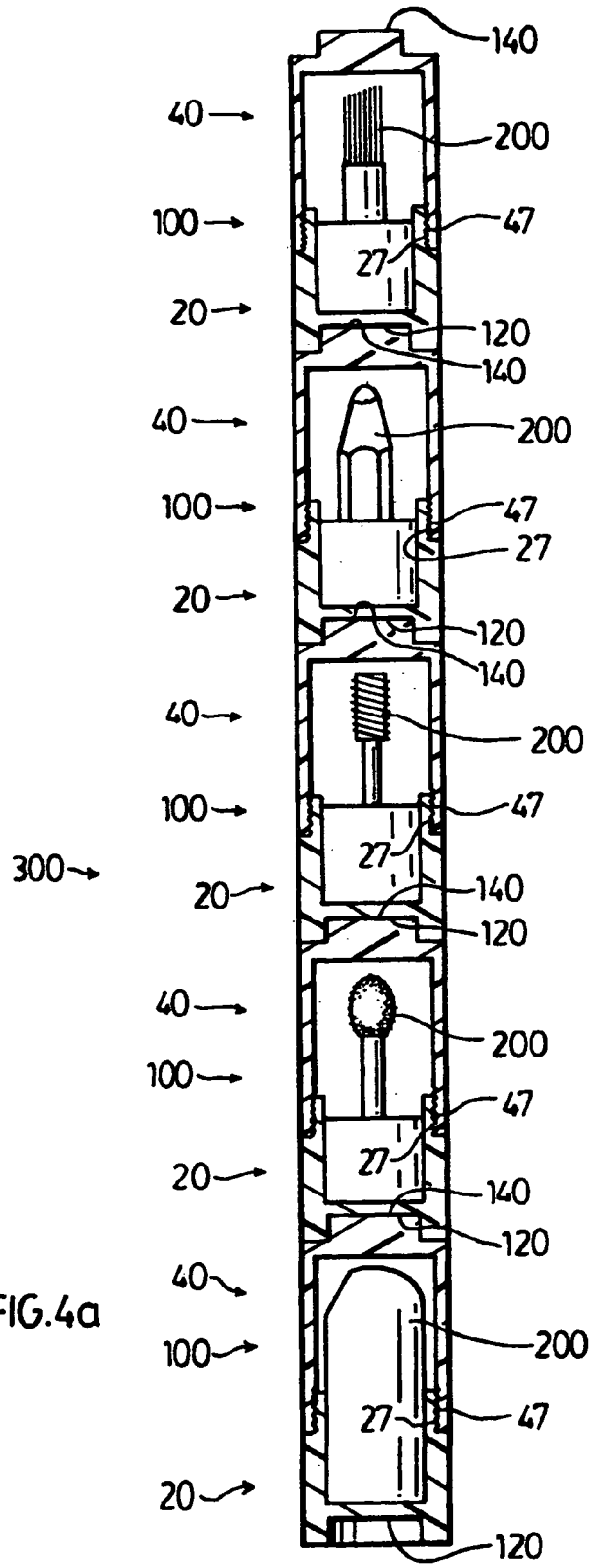
FIG. 4*a* is a side section view illustration of a first cosmetic, medical, toy package assembly embodiment of the present invention comprised of 5 cosmetic, medical, toy package elements.

Referring to FIG. 4*a*, multiple cosmetic, medical, toys package elements 100 may be combined to form a cosmetic, medical, toy package assembly 300. In the cosmetic, medical, toy package assembly embodiment shown in FIG. 4*a*, the assembly is formed by press-connecting the element connector 120 in the cosmetic, medical, toy container 20 with the complementary element connector 140 in the adjacent container closure 40. Since each cosmetic, medical, toy package element 100 has its own container closure 40, the order of the cosmetic, medical, toy package elements 100 within the cosmetic, medical, toy package assembly 300 is not fixed and may change.

Figure 4B:
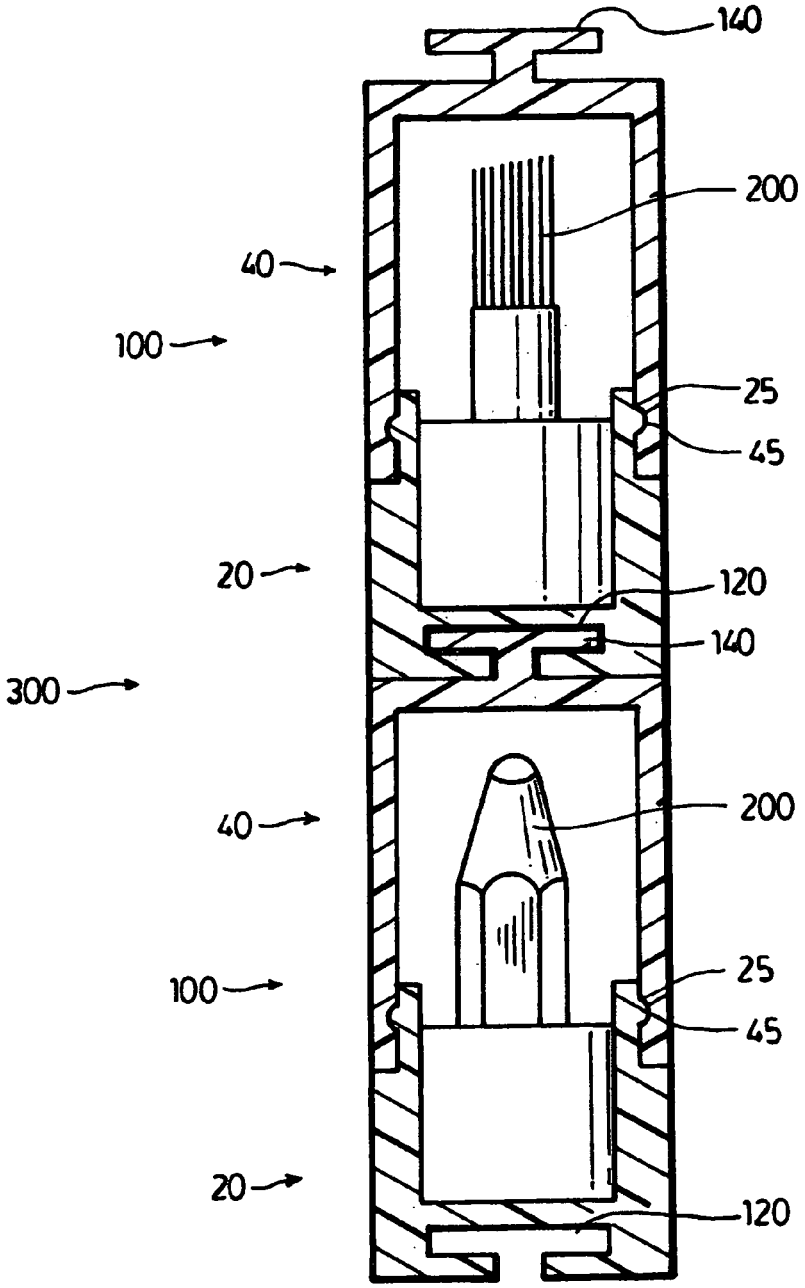
FIG. 4*b* is a side section view illustration of an alternate cosmetic, medical, toy package assembly embodiment of the present invention comprised of two cosmetic, medical, toy package elements.

FIG. 4*b* illustrates a similar package assembly 300 in which the element connectors 120 and 140 are tongue and groove connections. The cosmetic, medical, toy container closure 40 in this embodiment are shown with a press-fit seal 25 and 45.

Figures 5A, 5B:
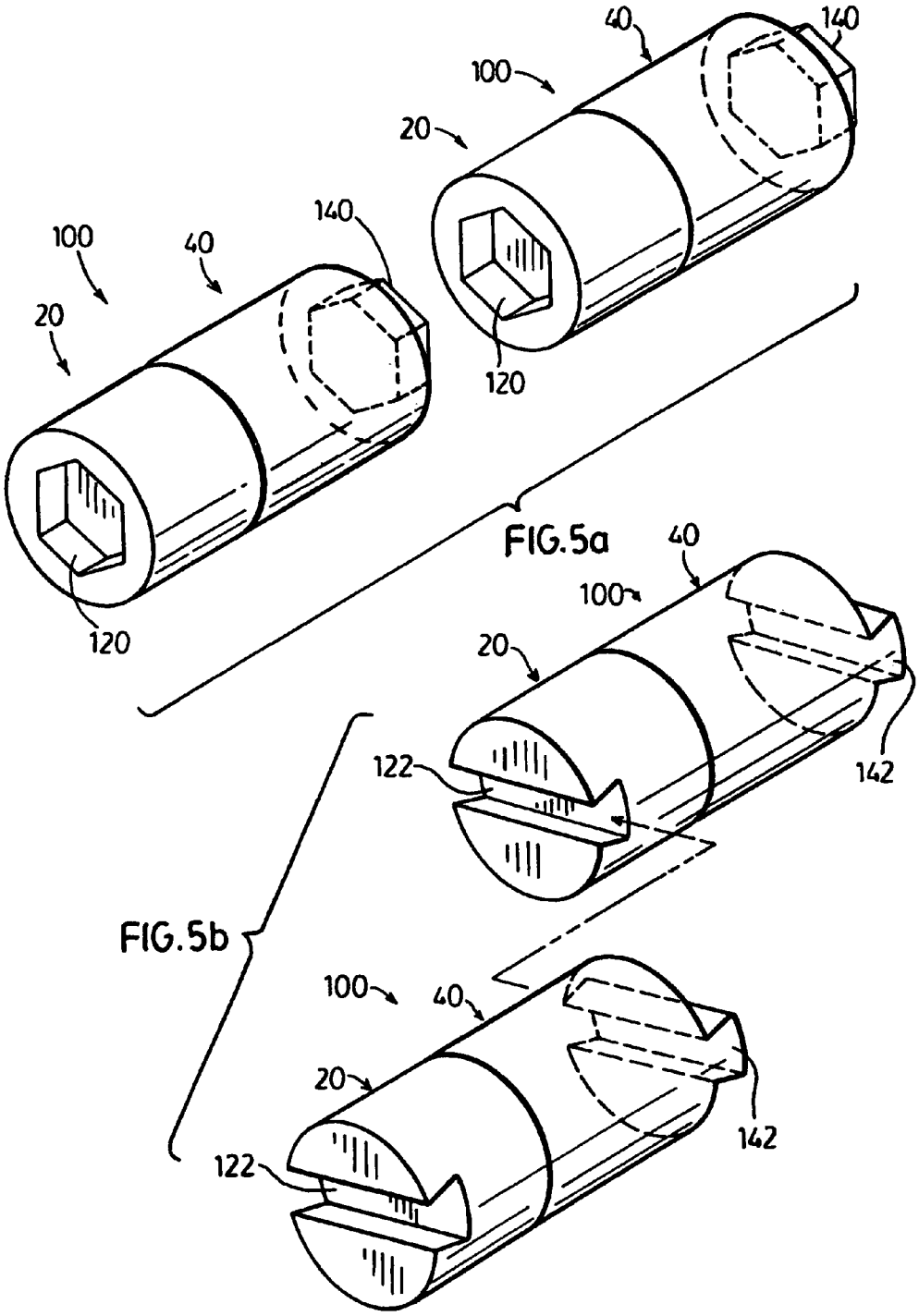
FIG. 5*a* is an isometric illustration showing two package elements of an embodiment of the present invention.
FIG. 5*b* is an isometric illustration showing two package elements of an alternate embodiment of the present invention.

FIGS. 5*a* and 5*b* are isometric illustrations of the connection process according to two embodiments of the present invention.

FIG. 5*a* illustrates a press-connect arrangement in which elements 100 are combined by pressing a male element connector 140 into a complimentary female element connector 120. As depicted in FIG. 5*a*, the press-connect shape is preferably one that resists rotation of the elements 100 when connected. This is preferred where the releasable seal consists of threads 27 and 47 to avoid adjacent elements rotating instead of the container closure 40 and the container 20 of the makeup, medical, toy element 100 being opened. While it is possible for a user to grip only a container closure 40 and corresponding container 20 when opening or closing an element 100, it is preferred to have element connector 120 and complementary element connector 140 that resist rotation for ease of use.

While a circular press-connect could provide sufficient resistance to rotation by friction alone, a non-circular shape is preferred as it eliminates the risk of slippage between elements 100 when a threaded closure connector 27 and 47 is used. The press-connect element connector 120 and complementary connector 140 illustrated in FIG. 5*a* is by way of example only and may also comprise other shapes that resist the relative rotation of an element connector 120 with a connector 140, and the invention is not intended to be limited the embodiment illustrated. As will be appreciated, the location of element connector 120 and 140 may be reversed to provide for a connector 120 on a container closure 40 and a connector 140 on a container 20 without departing from the intent of the invention.

FIG. 5*b* illustrates an alternate interconnection that comprises a sliding connection with a dovetail groove element connector 122 and tongue complementary element connector 142. Preferably the connectors provide a detent, snap or other locking mechanism (not shown) to lock adjacent elements 100 into alignment with one another when they are connected to comprise an assembly 300.

In a embodiment the groove element connector 122 may terminate short of the sidewall of the element 100. In this embodiment, the groove element connector 122 and tongue complementary element connector 142 may only be interconnected in a single sliding direction and removed by reversing the sliding direction. An advantage of this embodiment is that the elements 100 are more securely interconnected, and the locking mechanism is only required to resist motion in a single direction. As will be appreciated, similar to the press-connect interconnection, the relative location of the groove element connector 122 and tongue complementary element connector 142 and the container closure 40 and container 20 may be reversed without departing from the intent of the invention.

Figures 6A, 6B:
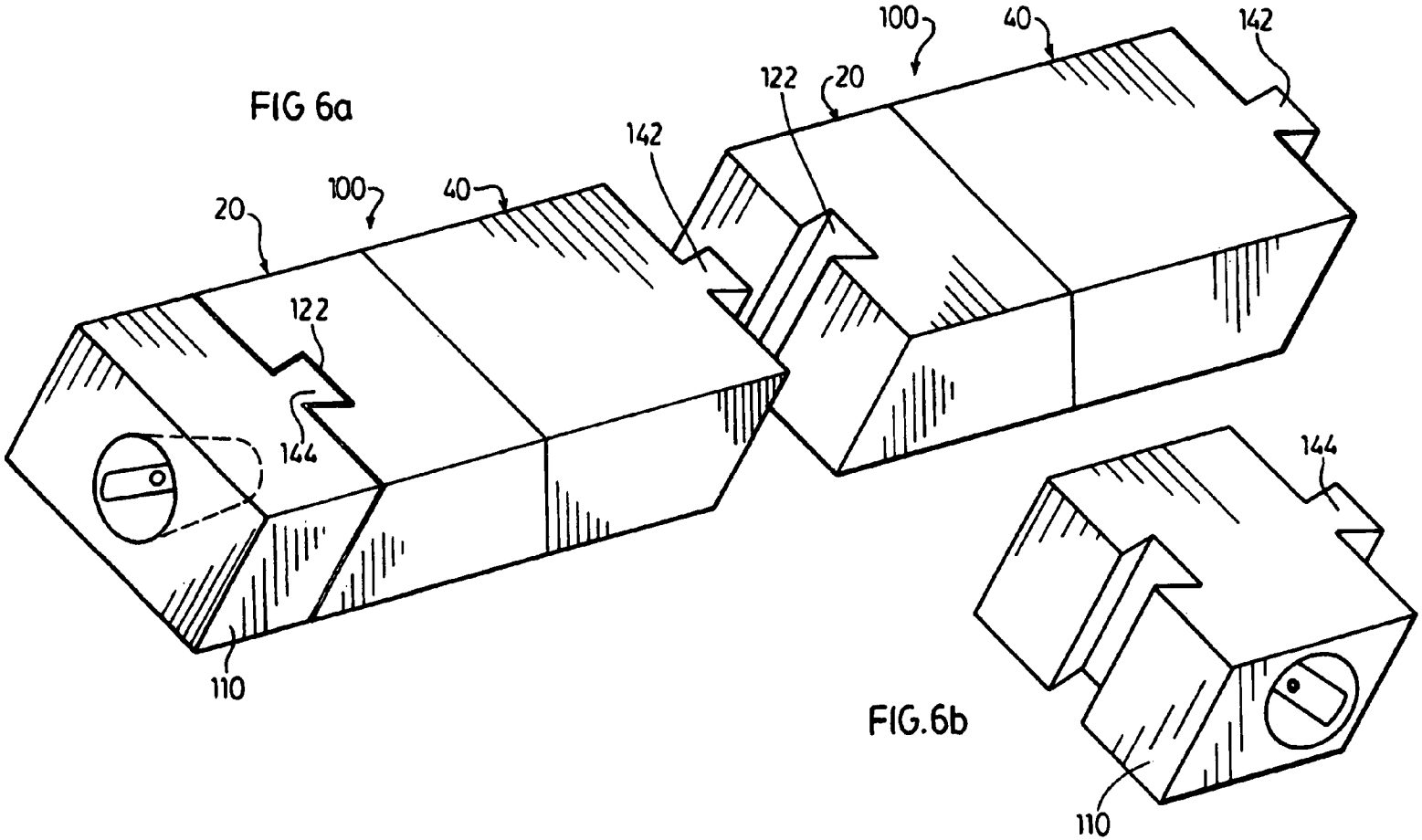
FIG. 6*a* is an isometric illustration of a cosmetic, medical, toy package assembly embodiment of the present invention including a sharpener.
FIG. 6*b* is an isometric illustration of an alternate sharpener embodiment.

FIG. 6*a* is an isometric illustration of an alternate embodiment featuring squared elements 100 with slanted ends of the container closure 40 and cosmetic, medical, toys container 20. In the embodiment illustrated in FIG. 6*a* the interconnection is by way of a groove element connector 122 and tongue complementary element connector 142. In this embodiment the element connector 122 and complementary element connector 142 may be a dovetail, T-shape, or other suitable tongue and groove connection. The end element of FIG. 6*a* is shown as a sharpener 110. The sharpener 110 may either comprise an end element with only a single connector 122, or alternatively may be provided with a connector on each end and a sharpener located on a side of the sharpener 110, as shown in FIG. 6*b*.

Figure 7A:
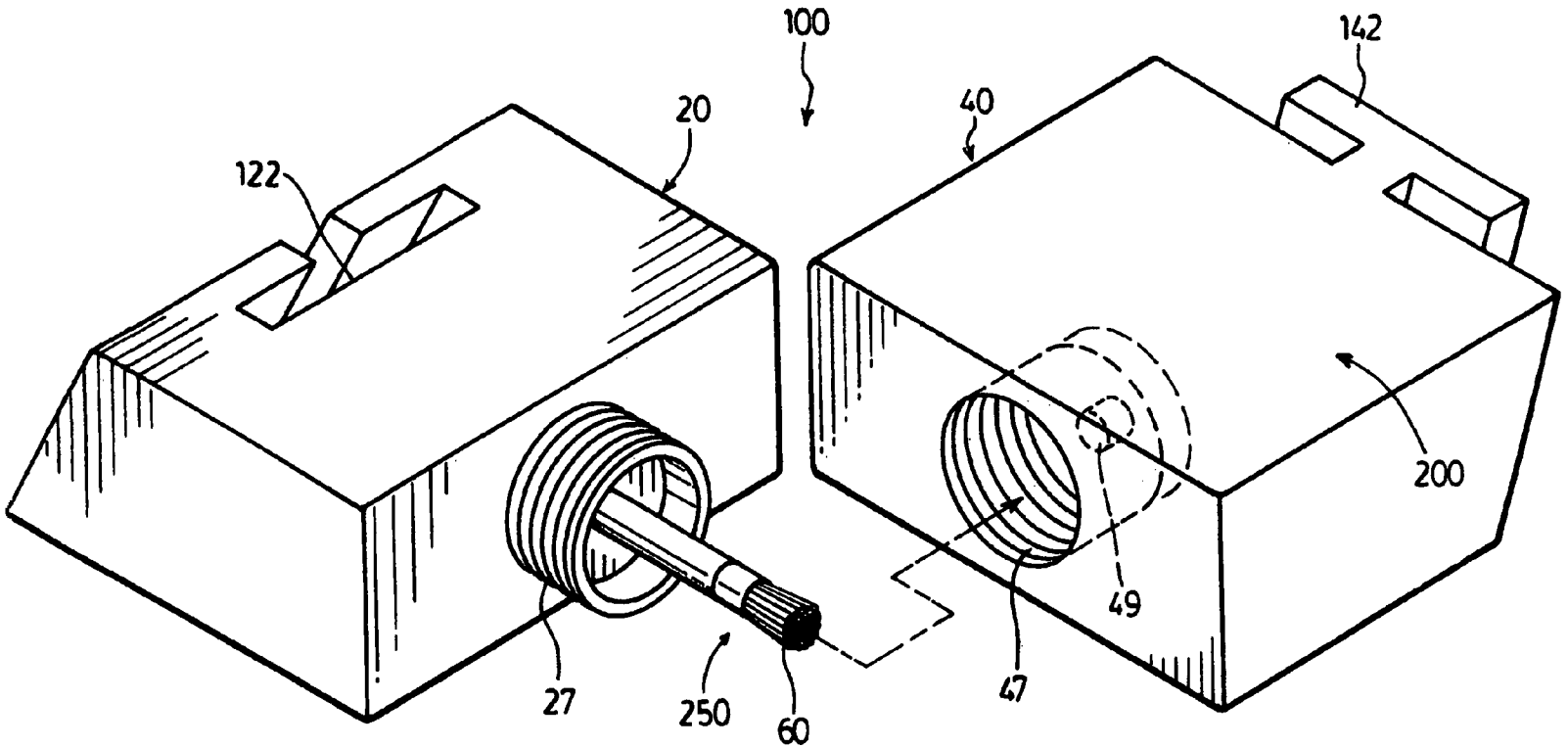
FIG. 7*a* is an isometric illustration of a cosmetic, medical, toy package element embodiment containing a liquid cosmetic, medical medicine, toys and an applicator.
Figure 7B:
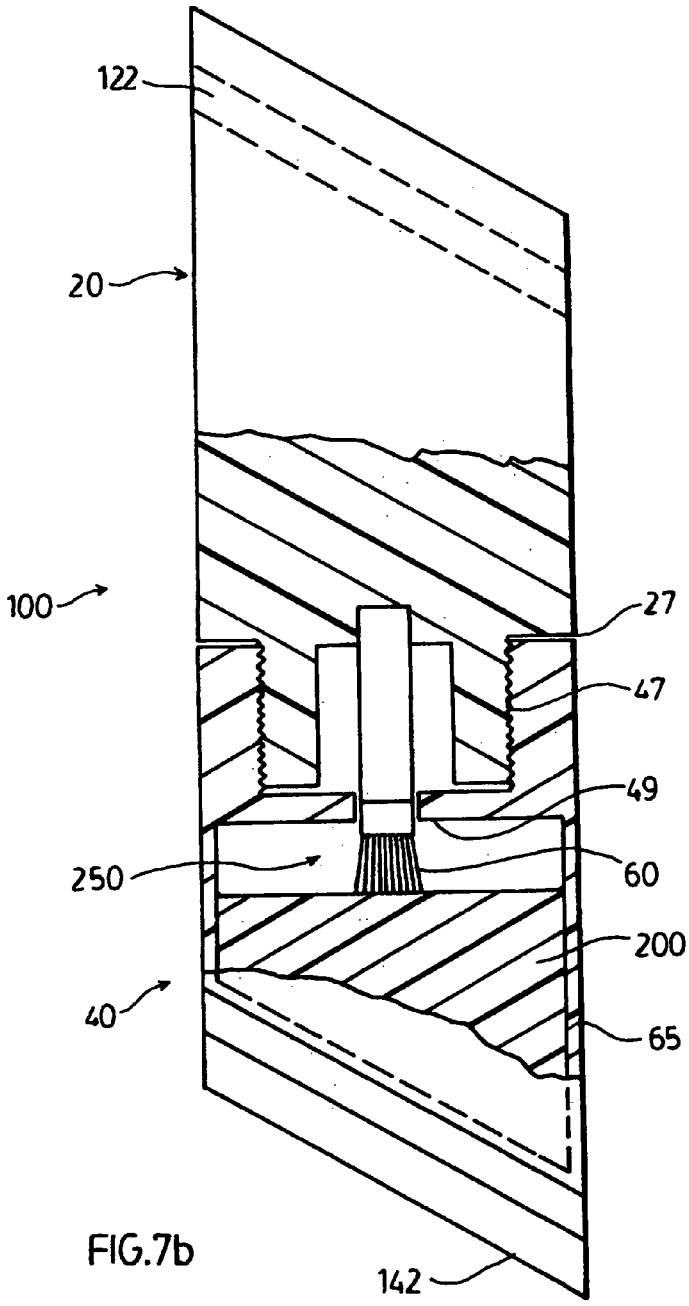
FIG. 7*b* is a side section view illustration of a cosmetic, medical, toy package element embodiment containing a liquid cosmetic, medical, toy and an applicator.

The configuration of a container closure 40 and container 20 for a particular element 100 may vary internally while maintaining the same exterior configuration. Specifically, the internal configuration of a container closure 40 and container 20 may be adapted to house a specific cosmetic, medical, toy 200. For instance, FIGS. 7*a* and 7*b* illustration embodiment where the element 100 compromises a container 20 that compromises a reservoir 65 for storing a liquid cosmetic, medicine, toy 200, and a container closure 40 that comprises an applicator 250. In the embodiment shown, the applicator 250 is a nail polish brush 60 and the cosmetic, medical, toy 200 is nail polish within the reservoir 65, which could also be used for medicine and toys.

In the embodiment shown, the container closure 40 includes an opening 49 of reduced size to accommodate the nail polish brush 60, which could also be used for medicine and toys, and the use the shaft of the brush 60 to stopper the reservoir. Thus while the external configuration of the elements 100 is preserved, the internal configuration may be adapted as necessary, to accommodate and preserve the cosmetic, medical and toy 200 contained therein. As indicated above, the relative location of the applicator 250 and the reservoir 65 is for descriptive purposes and is not intended to be limiting.

Figure 8:
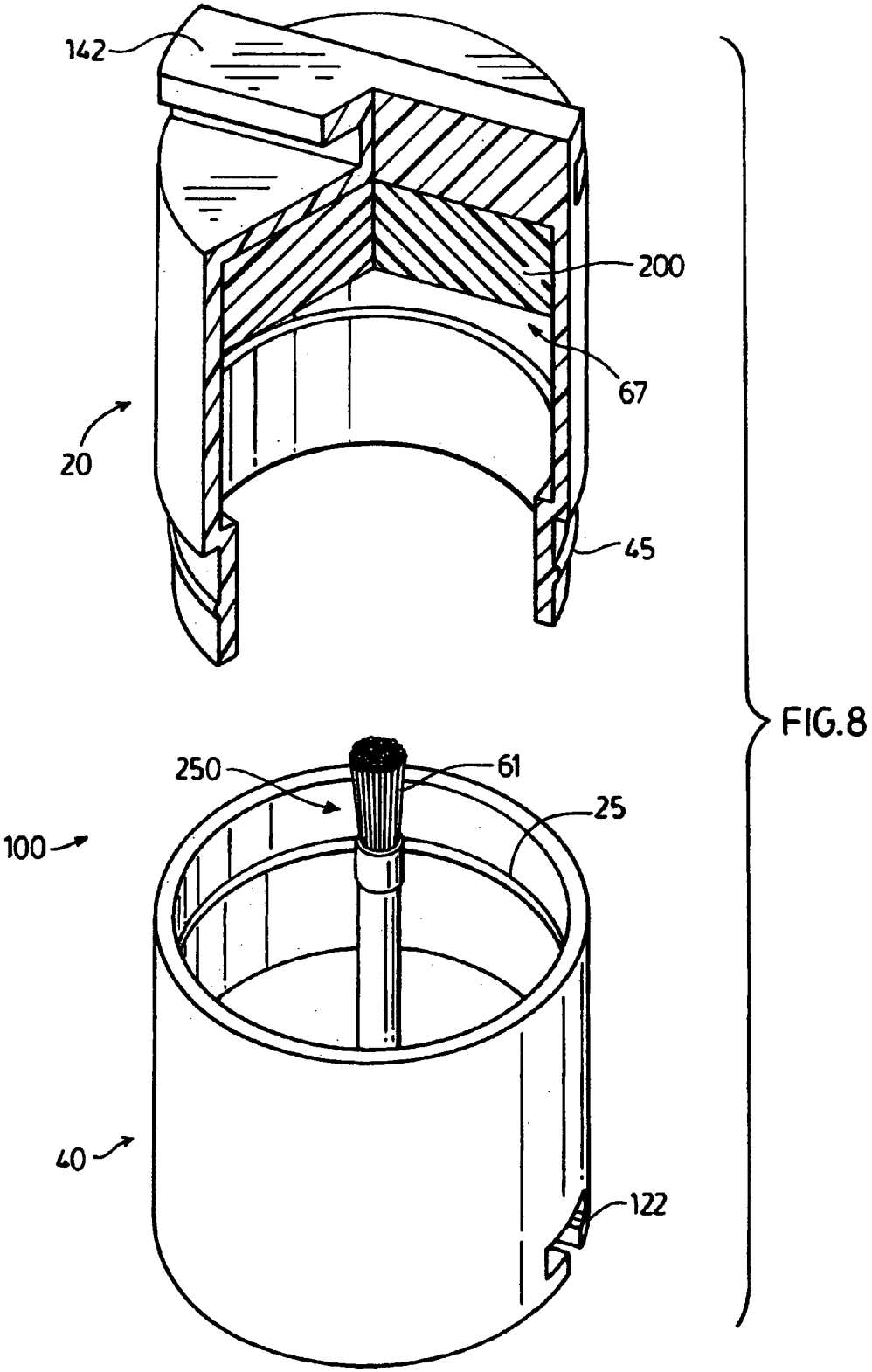
FIG. 8 is an isometric and section view illustration of a cosmetic, medical, toy package element embodiment containing a paste or powder cosmetic, medical, toy and an applicator.

FIG. 8 is an isometric and isometric cutaway of an embodiment of element 100 containing a cosmetic, medical, toy 200 and applicator 250. In the embodiment of FIG. 8, the cosmetic, medical, toys container 20 comprises a reservoir 67 for storing a powder cosmetic, medical, toy, and the closure 40 comprises an applicator 250 that in the embodiment shown is a powder brush 61.

In operation a cosmetic, medical, toy package element 100 according to the present invention permits the creation of customized cosmetic, medical, toy package assembly 300 by the user containing specific cosmetics, medicine/pharmaceutical, toys 200 suitable for that particular day or event. Furthermore, in operation, the order of the cosmetic, medical, toys package elements 100 may be interchanged within the cosmetic, medical, toy package assembly 300 in order to facilitate application of a particular cosmetic, medical, toy 200. For instance, a cosmetic package assembly comprised of four cosmetic, medical, toy package elements 100 may be employed by a user to apply each of the cosmetics, medicines or use of toys (Face Paint for children) 200 in turn after interchanging the current cosmetic, medical, toy 200 with the next element 100 in the assembly.

In this manner each cosmetic, medical, toy package element 100 is provided with the benefit of being located at the end of the cosmetic, medical, toy package assembly 300. In other words each cosmetic, medical, toy package element 100 may take its turn as the end of element 100 in the cosmetic, medical, toy package assembly 300 that comprises a cosmetic, medical, toy applicator or handle for manipulating the end of 100.

For storage and transportation of the cosmetic, medical, toy package assembly 300, it thus becomes possible to separate the cosmetic, medical, toy package assembly 300 into smaller cosmetic, medical, toy package assemblies or simply into a collection of individual elements 100 during transport, and reconstituting or connecting the individual elements 100 together to form an elongated cosmetic, medical, toy package assembly 300 for application of a cosmetic, medical, toy 200. Alternatively, an individual cosmetic, medical, toy package element 100 may be removed from the assembly 300 if it would be simpler to apply the cosmetic, medical, toy 200 without the 100 being attached to the assembly 300. For example, lipstick is a cosmetic, medical, toy 200 that is typically applied in a small hand-held applicator and might be difficult or ungainly to apply if the lipstick element 100 is required to remain connected to the rest of the assembly 300 during application. A cosmetic, medical, toy package element 100 of the present invention containing lipstick may be removed from a cosmetic, medical, toy package assembly 300 for application, without exposing the cosmetic, medical, toy 200 in an adjacent cosmetic, medical, toy package element 100. alternatively, element 100 may be connected to a second element 100 to comprise a shortened assembly 300 for applying the cosmetic, medical, toy 200.

In an alternate embodiment, one or more of the elements 100 or sharpener 110 may be provided with a reflective exterior on at least one portion of their exterior surface. The reflective exterior may be used by a user when utilizing one of the elements 100. For instance, an element 100 that comprises a lipstick or medicinal use may be removed from an assembly 300 for application by a user. The user may employ the reflective exterior of the remainder assembly 300 as to aid in applying the lipstick or medicine, Since the lipstick element 100 may be removed from the assembly 300 without exposing the adjacent cosmetic, medical, toy 200, some or all of the remainder assembly 300 can be used useful used by the user to assist in applying lipstick, medicine or toy (Face Paint).

Conversely, if a user wishes to apply a lip-liner, or a lip outline pencil, then the liner or pencil element 100 could be substituted for the end element 100 in the assembly 300, for application, or could be separated as two elements 100 assembly 300 for convenience of application. In this manner, the connection of individual cosmetic, medical, toy package elements 100 to form an assembly 300 may be performed where convenient for transportation or application of a cosmetic 200. However, a user is afforded the convenience of transporting or applying a cosmetic, medical, toy 200 as either an individual element 100 or an abbreviated assembly 300 where application is aided by the addition of one or more elements 100 but the complete assembly 300 would be ungainly.

In circumstances where a user has a particular function or event for which they need a cosmetic, medical, toy 200, a customized cosmetic, medical, toy package assembly 300 may be created by selecting suitable elements 100. Thus if the user is traveling for the day but is planning to go out at night, the user may apply their day makeup or medical selection at home and combine a cosmetic, medical, toy package assembly at home and combine a cosmetic, medical, toy package assembly 300 comprised of a day lipstick, an evening lipstick and a evening makeup or medical choices.

Thus while traveling, the user may apply or re-apply the daytime lipstick as required and still use the daytime cosmetic, medical, toy package element 100 as an element 100 of a cosmetic, medical, toy assembly 300 when applying the evening makeup and the use of medical products. In this fashion, a user is able to select the number and type of elements 100 particularly suited for their needs on any particular day.

Similarly if the cosmetic, medical, toy supply in an individual cosmetic, medical, toy package element 100 is exhausted, the user is able to replenish that individual cosmetic, medical, toy package element 100 alone without having to replace the rest of the elements 100 in the assembly 300. This is particularly useful in circumstances where a user may frequently apply a particular cosmetic, medical, toy 200 and only seldom apply or reapply the cosmetic, medical, toy 200 contained in the other elements 100.

Figures 9A, 9B:
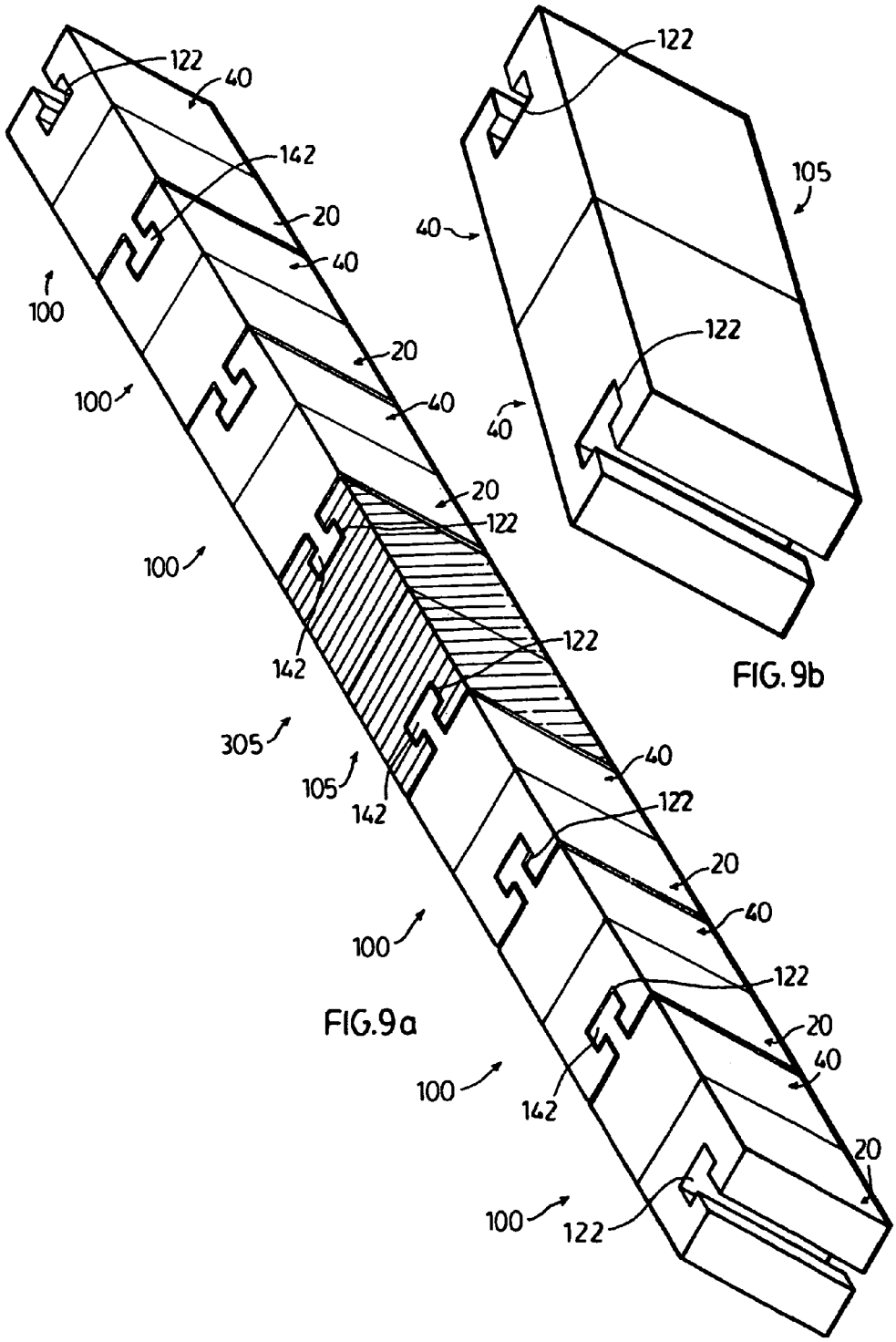
FIG. 9*a* is an isometric view illustration of a cosmetic package assembly embodiment of the present invention including a central package element.
FIG. 9*b* is an isometric magnified view illustration of the central package element.

FIGS. 9*a* and 9*b* provide an alternate embodiment of the present invention in which element 105 may be provided with either an element connector 120,122 or a complementary element connector 140,142 disposed at both ends of the element 105. The element 105 of the embodiment of FIGS. 9*a* and 9*b* provides a central connecting element 105 that permits the creation of assembly 305 with a container closure 40 disposed at each end of the assembly 305. One of the container closures 40 comprises a closure connector 25,27 and the other of the container closures 40 comprises a complementary closure connector 45,47.

Preferably central connecting element 105 may be provided with a reflective surface on the exterior and/or may comprise a hollow chamber for storage. In an alternate embodiment, element 105 may comprise a container 20 and a container closure 40, where both comprise either an element connector 120, 122 or a complementary element connector 140,142.

Figures 10A, 10B:
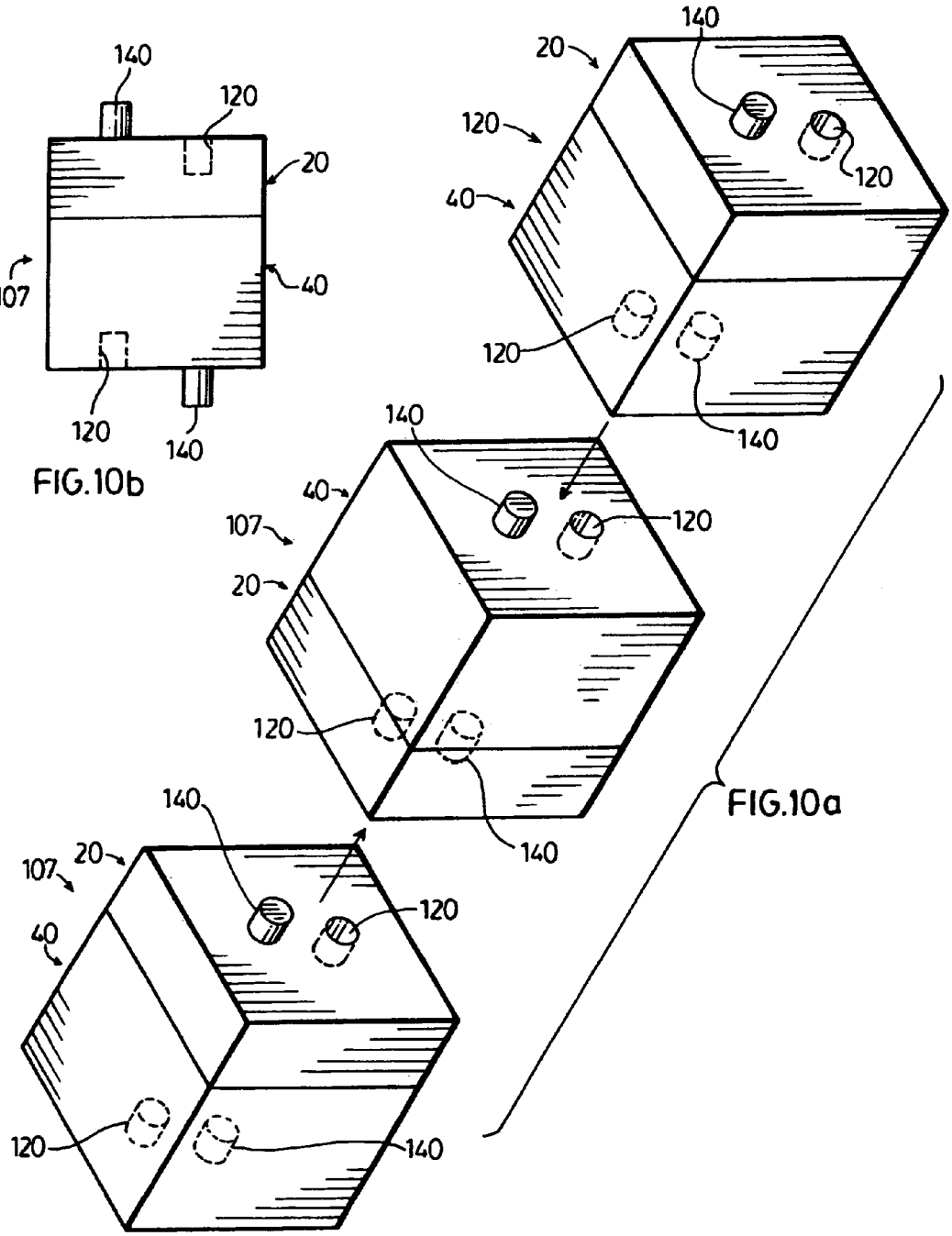
FIG. 10*a* is an isometric view illustration of a further embodiment of a cosmetic, medical, toy package assembly embodiment of the present invention comprised of further cosmetic, medical, toy elements.
FIG. 10*b* is a side view illustration of the further cosmetic, medical, toy package element.
Figure 11:
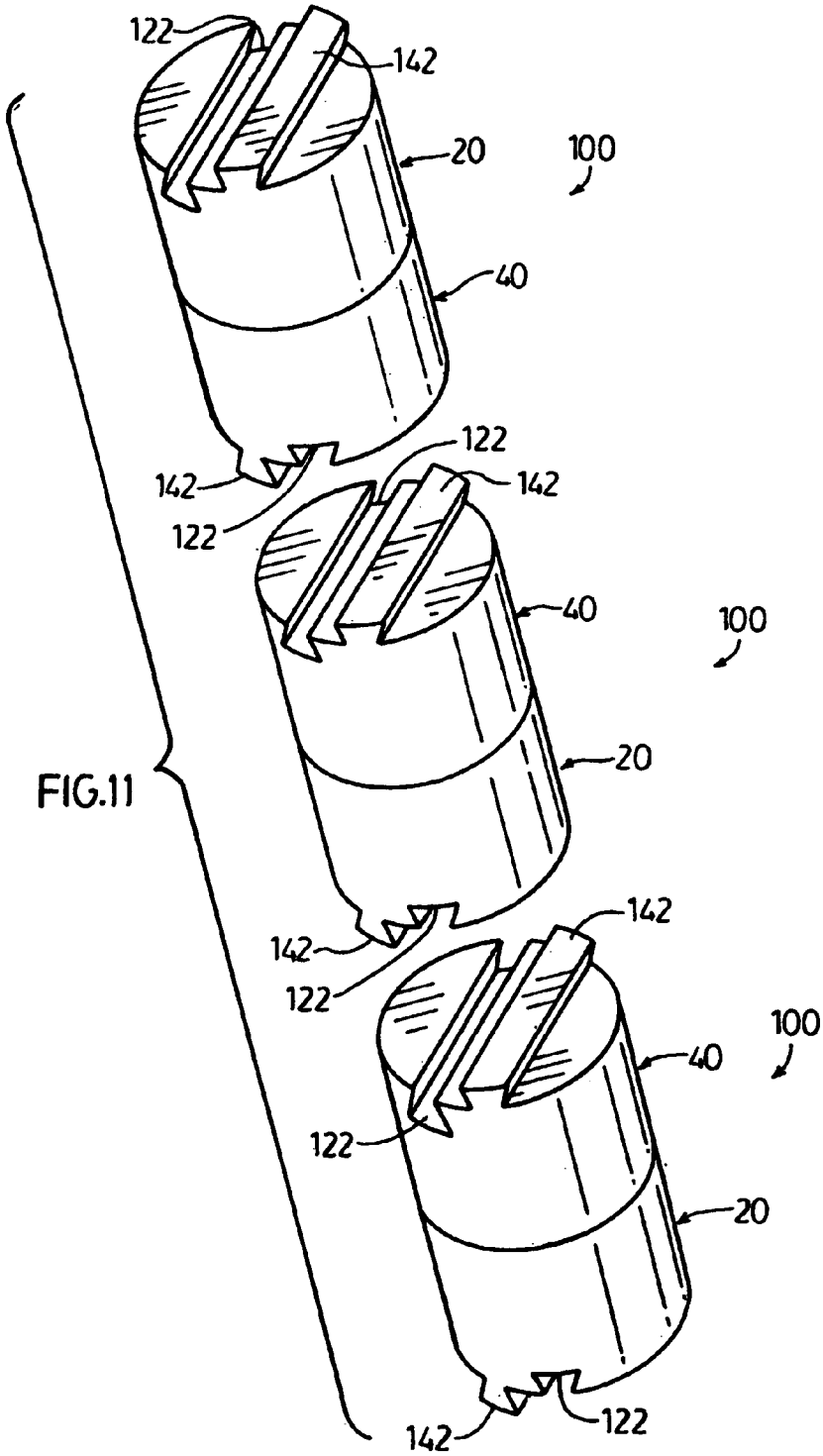
FIG. 11 is an isometric view illustration of a further embodiment of the cosmetic, medical, toy package element of the invention.

As illustrated in FIGS. 10*a*, 10*b* and 11, a further embodiment provides a cosmetic, medical, toy package element 107 with both an element connector 120,122 and a complementary element connector 140, 142 located on each end of element 107. The use of both types of connectors on each of the cosmetic, medical, toy container 20 and container closure 40 permits independent orientation of each element 105 within an assembly of elements 107. The embodiment of FIGS. 10*a*, 10*b* and 11 provides the additional advantage that either end of an assembly may comprise an element 107 oriented to dispose the container closure 40 facing outward. Unlike the embodiments illustrated in FIGS. 9*a* and 9*b*, no specific orientation of elements 107 is required to comprise such an assembly.

Figure 13:
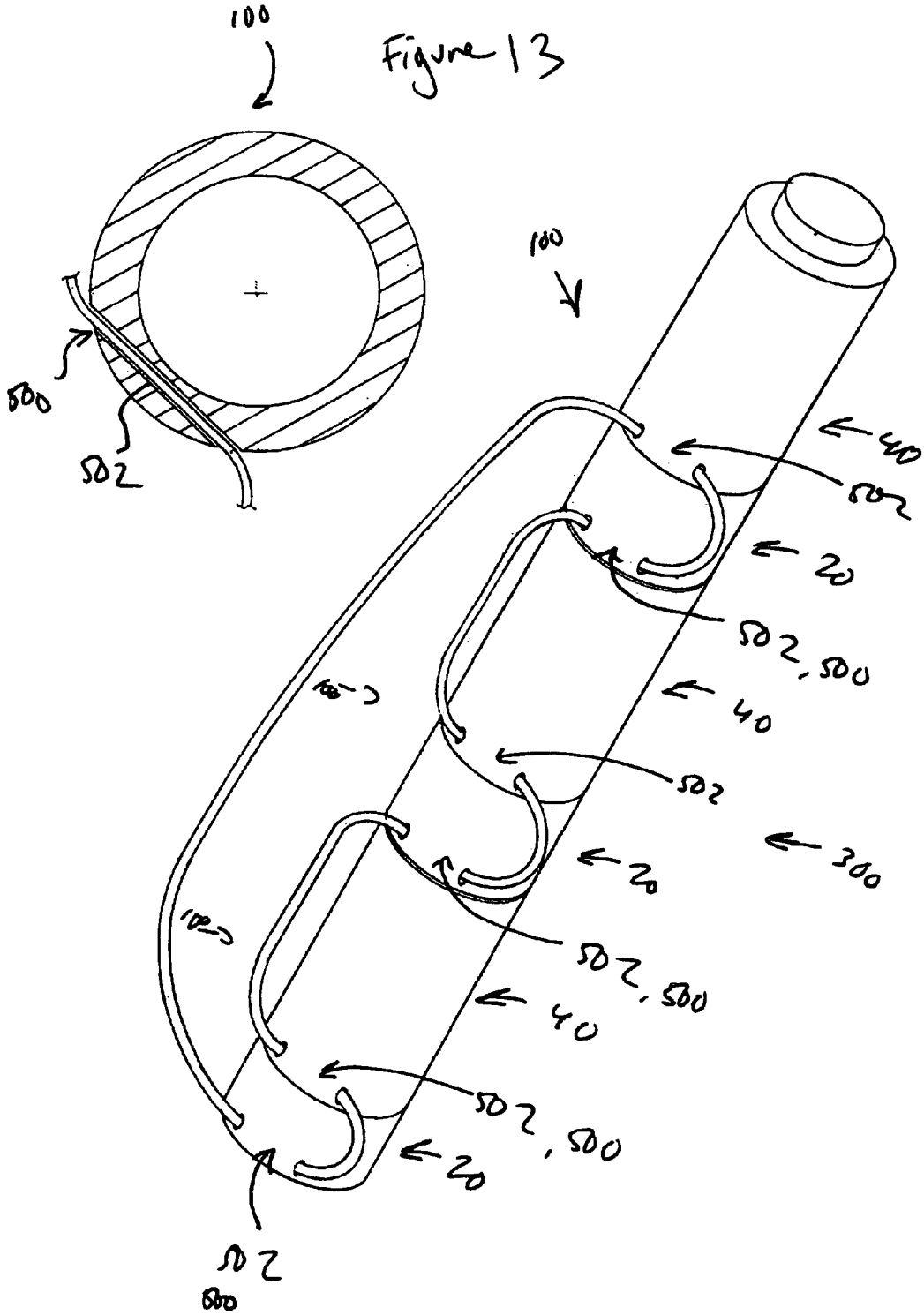
FIG. 13 is a view of an internal, external connector.

In an embodiment, a cosmetic package element 100, 105, 107 may comprise a connection point 500 integrally formed with an exterior portion of the element 100, 105, 107. The connection point 500 may comprise an eye through the surface of the element 100, 105, 107 for receiving and securing a connector 506 to the element 100, 105, 107 as illustrated in FIGS. 12*a* and 12*b*. Alternatively, as illustrated in FIG. 13, the connection point may comprise a passage 502 through a portion of the element 100, 105, 107. In a further alternative, illustrated in FIG. 12*c*, the connection point 500 may comprise a passage 503 through both the closure 40 and the container 20 for further securing the closure 40 to the container 20 when a connector 506 is passed through the passage 502.

The connector 506 may comprise a tie, thread, key ring, loop of fabric, chain, plastic tie, or other connection means for securing the element 100, 105, 107 to another object. When the element 100, 105, 107 is assembled into an assembly 300, the connection point 500 provides a convenient means to secure the assembly 300 to another object.

In an embodiment the connection point may be oriented to align with connection points of adjacent elements 100, 105, 107 when assembled into the assembly 300, as illustrated in FIGS. 14 and 15. In this embodiment securing the connector 506 to the assembly 300 comprises threading the connector through the connection point 500 for each element 100, 105, 107, thus securing all elements 100, 105, 107 in the assembly 300.

Figure 14B:
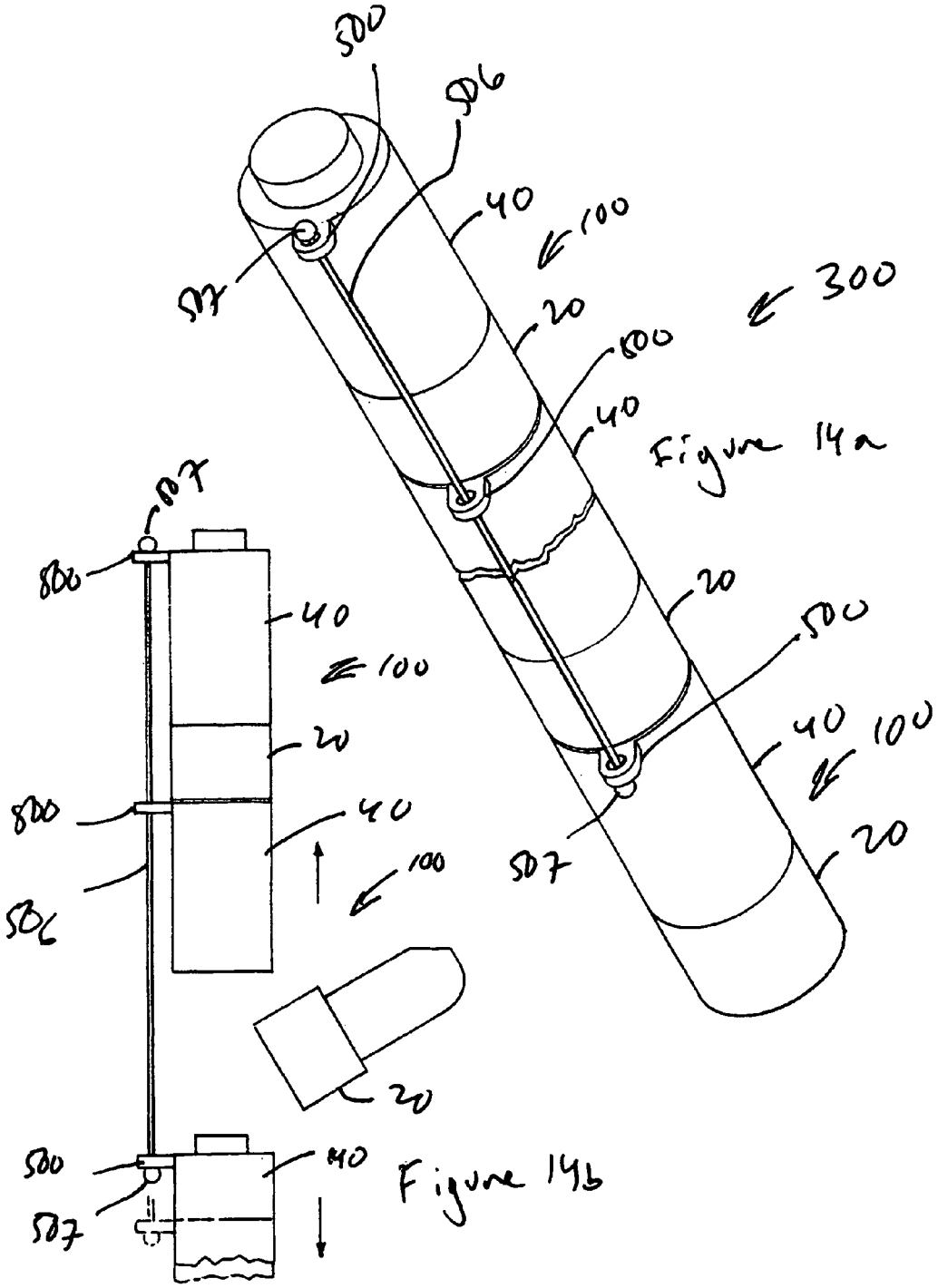
FIG. 14*b* is a left side view of the FIG. 14*a*.

In the embodiment illustrated in FIGS. 14*a* and 14*b* only the closures 40 comprise a connection point 500. In such an embodiment the connector 506 may be used to align the elements 100, 105, 107 in the assembly 300, but a specific container 20 may be released from the assembly 300 without disrupting the rest of the assembly 300. In the embodiment illustrated in FIGS. 14*a* and 14*b* the connector 506 may comprise an elastic member, that may be extended to allow removal of an element 100, 105, 107 as illustrated in FIG. 14*b*.

Figure 15B:
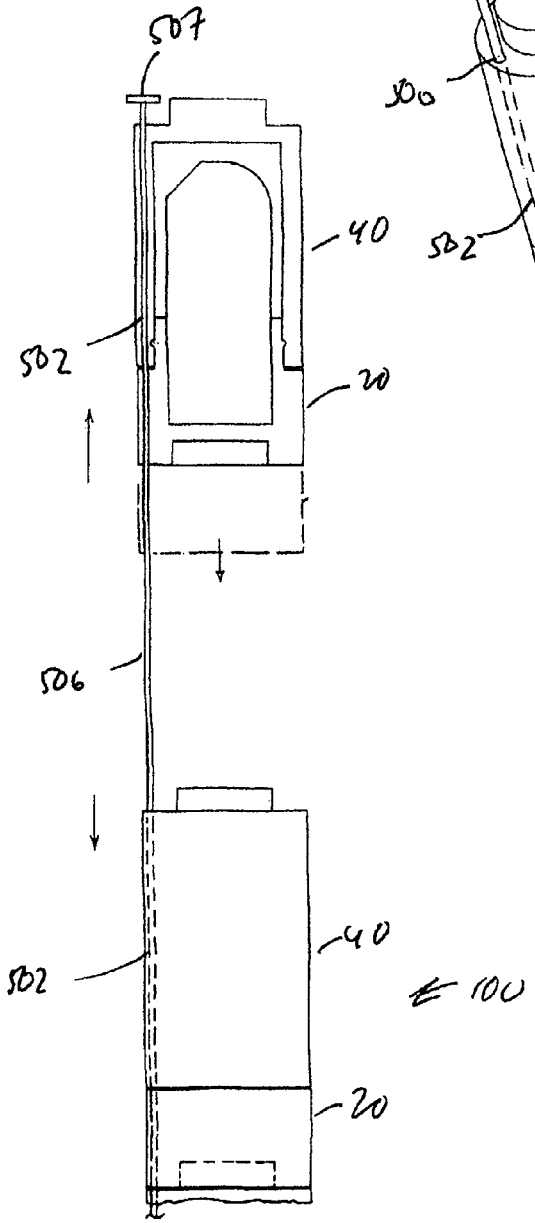
FIG. 15*b* is a left side elevational view of FIG. 15*a*.
Figure 15A:
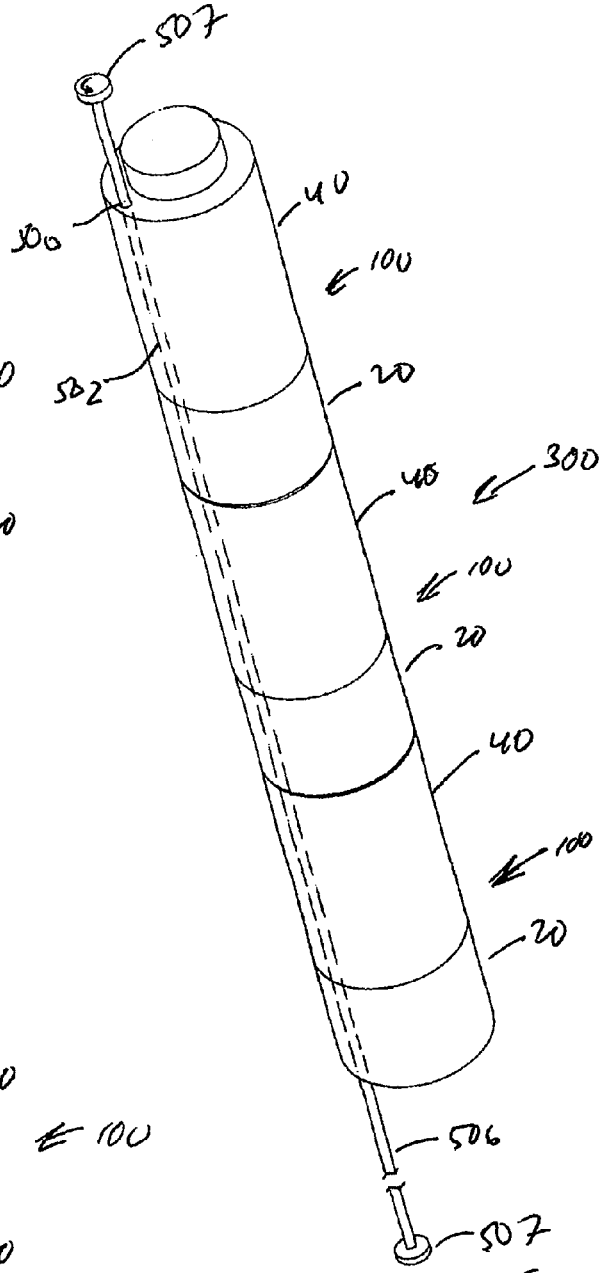
FIG. 15*a* is a left side elevational view of a rigid connector passing through the elements.

In an embodiment illustrated in FIGS. 15*a* and 15*b*, both the closures 40 and the containers 20 comprise a connection point 500. As illustrated, the connection point 500 in this embodiment comprises a passage 502 through both the closures 40 and the containers 20. A connector 506 may be threaded through the passage 502 to secure the assembly 300. The connector 506 may comprise an elastic member, as in FIGS. 14*a* and 14*b*, or may comprise a rigid member with ends 507 that may be configured to either resist passing through the passage 502 or that may be configured to allow passing through the passage 502. Alternatively, the ends 507 may be configured to allow removal from the connector 506, for instance by unscrewing from a threaded connector 506 as illustrated in FIG. 15*a*.

Accordingly an assembly 300 may be constructed by sliding a series of desired elements 100, 105, 107 onto the connector 506 and then fixing the assembly 300 by configuring the ends 507 to resist passing through the passage 502.

Various embodiments of the present invention having been thus described in detail by way of example, it will be apparent to those skilled in the art that variations and modifications may be made without departing from the invention. The invention includes all such variations and modifications as fall within the scope of the appended claims.

I claim:

1. A package element for storing a cosmetic, the element comprising a cosmetic, medical, toy container comprising a container element connector and a container closure connector; and, a container closure comprising a complementary element connector for connecting to the container element connector, and a complementary closure connector for connecting to the container closure connector to releasable seal the container closure to the cosmetic, medical, toy container; whereby the container element connector of a first package element may be connected to a complementary element connector of a second package element for connecting the cosmetic, medical, toy closure of the second package element, all of these package elements are interchangeable, have air tight seals to carry liquids and creams, are also hygienic elements some of the components have a mirror on the exterior for easy application for the consumer as well as a pencil sharpener the container element connector and container closure connector are each unitarily formed as a single piece.

2. The package element of claim 1 wherein the second package element forms all or part of a handle for manipulating the first package element.

3. A package element assembly comprising at least two package elements of claim 1 connected by connecting the element connector of the first package element with the complementary element connector of the second package element.

4. A central package element for connecting to two package elements of claim 1, the central package element comprising, a pair of container closures each comprising a container element connector, and one container closure comprising a container closure connector and the other comprising a complementary closure connector for connecting to the closure connector to releasable seal the central package element; whereby the container closures of the central package element may be combined with the complementary element connectors of the two package elements.

5. A package element assembly comprising the central package element of claim 4 connected to at least two package elements by combining the complementary element connector of a first package element with the element connector of the one container closure and combining the complementary element connector of a second package element with the element connector of the other container closure.

6. The package element of claim 1 wherein the element connector comprises a male connector and the complementary element connector comprises a female connector.

7. The package element of claim 6 wherein the element connector comprises a tongue and the complementary element connector comprises a groove.

8. The package element of claim 6 wherein the container closure connector and the complementary container closure connector comprise mating threads.

9. The package element of claim 6 wherein the element connector and complementary element connector are shaped to resist rotation.

10. The package element of claim 6 wherein the container closure connector and the complementary container closure connector comprise a press-fit connection.

11. A package element for storing a cosmetic, medical, toy, the element comprising, a cosmetic, medical, toy container comprising a container element connector, a complementary element connector and a closure connector, the complementary element connector adapted to connect with the container element connector and a container closure comprising a container element connector, a complementary element connector and a complementary closure connector for connecting to the closure connector to releasable seal the cosmetic, medical, toy container; whereby both the cosmetic, medical, toy container and the element connector may be connected to either a container closure of another package element or a cosmetic, medical, toy container of another package element, all of these package elements are interchangeable, have air tight seals to carry liquids and creams, are also hygienic elements some of the components have a mirror on the exterior for easy application for the consumer as well as a pencil sharpener the container element connector and the container closure connector are each unitarily formed as a single piece.

12. The package element of claim 11 wherein the element connector comprises a male connector and the complementary element connector comprises a female connector.

13. The package element of claim 12 wherein the element connector comprises a tongue and the complementary element connector comprises a groove.

14. A package element assembly comprising at least two package elements of claim 11 connected by connecting the element connector and the complementary element connector of either the cosmetic, medical, toy container closure of the first package element with the complementary element connector and the element connector of either the cosmetic, medical, toy container closure of the second package element.

15. The assembly of claim 14 wherein the second package element forms all or part of a handle for manipulating the first package element.

16. A package element of any one of claims 1 to 15 further comprising a connection point on an exterior portion of the element for receiving and securing a connector to the element.

17. The package element of claim 16 wherein the connection point comprises a passage through the exterior portion of the element.

18. The package element of claim 17 wherein the passage of one element aligns with the passage of an adjacent element to receive the connector through both elements.

19. The package elements of claim 1 or claim 11 where the container element connector can be attached to any complementary element connector or complementary closure connector of a second package element allowing the elements to be attached in both directions, as well as any number of elements can be attached to a connector component which is used to attach the assembly of interchangeable components, the connector component may comprise a tie, thread, key ring, loop of fabric, chain, plastic tie, or other connection means for securing the element (100, 105, 107,) to another object, when the element (100, 105, 107,) is assembled into an assembly (300,) the connection point provides a convenient means to secure assembly to another object.

* * * * *